US006427856B1

(12) United States Patent
Allen

(10) Patent No.: US 6,427,856 B1
(45) Date of Patent: Aug. 6, 2002

(54) SELF-CENTERING DEVICE FOR A ROTATING DISPLAY

(75) Inventor: Michael C. Allen, Monroe, NY (US)

(73) Assignee: Trans World Marketing Corp., East Ruthesford, NJ (US)

( * ) Notice: Subject to any disclaimer, the term of this patent is extended or adjusted under 35 U.S.C. 154(b) by 0 days.

(21) Appl. No.: 09/614,072

(22) Filed: Jul. 11, 2000

(51) Int. Cl.[7] ..... A47F 5/02

(52) U.S. Cl. ..... 211/163; 211/77; 33/520; 248/349.1

(58) Field of Search ..... 211/163, 77, 78; 33/613, 645, 533, 568, 569, 573, 520, 644; 248/144, 131

(56) References Cited

U.S. PATENT DOCUMENTS 3,199,826 A * 8/1965 Miller et al. ..... 248/349.1
3,691,871 A * 9/1972 Gladow et al. ..... 33/832
4,191,437 A * 3/1980 Funke ..... 248/349.1
4,919,383 A * 4/1990 Benjamin et al. ..... 248/349.1
5,000,513 A * 3/1991 Schmidt ..... 248/349.1

* cited by examiner

*Primary Examiner*—Diego Gutierrez
*Assistant Examiner*—Lydia M. De Jesús
(74) *Attorney, Agent, or Firm*—Dickstein Shapiro Morin & Oshinsky LLP

(57) ABSTRACT

A self-centering device for assuring that two plates that are rotatable with respect to one another will automatically align in one of two-stable positions. The device includes an O-ring entrained about two spaced posts located on the upper face of a bottom one of the plates and a roller depending from the bottom face of the upper one of the plates into a circumscribed space defined by the O-ring. When an external rotatable force is applied to the upper plate, an elastic force is applied to the roller such that when the external force is removed, the roller will move into one of the two stable positions.

11 Claims, 3 Drawing Sheets

10
16
12
14
18

14
16
22
26
24
28
16

SELF-CENTERING DEVICE FOR A ROTATING DISPLAY

BACKGROUND OF THE INVENTION

This invention relates to rotating displays and to self-centering devices onto which such displays may be mounted and, more particularly, to displays and devices which may be easily rotated by consumers and which automatically align in one of a plurality of desired angular positions when released by the consumer.

Displays used for marketing purposes may contain, for example, advertising materials, working models or a product arranged in an attractive manner on the display. In many instances, for reasons of space efficiency as well as effective marketing, it may be desirable to place information, products or the like in large quantities on a single display, hence, it is often desirable to utilize a circular or polygonal display holder wherein products or materials to be displayed are placed along all sides of the holder. When a display is arranged in this manner, it is desirable that the display be capable of rotation such that a viewer approaching from one side may, without moving, easily rotate the display to view any of the other sides.

For many applications, it is desirable that the rotating display, prior to rotation, be oriented in a predetermined starting position. For example, in a room where the physical layout makes it highly likely that a consumer will initially approach the display from a particular direction, the side of the display most likely to attract a consumer's attention should desirably face the likely direction of consumer approach. In some applications a display may set forth information which is best viewed in a sequential manner, and of course would desirably be oriented such that the initial information of the sequence faces the expected direction from which consumers are likely to approach.

A problem with rotating displays is that, while they make it convenient for a consumer to view all sides, they are often rotated to a less than desirable starting position from which to attract the next consumer who passes the display. Hence, there is a need for displays capable of automatically rotating to a desired predetermined orientation.

For many purposes, more than one initial orientation would be suitable. For example, if the display were a two-sided poster, either of the two starting orientations (where one poster side or the other faces the likely direction of consumer approach) would be preferred. Where there are alternative appropriate initial oppositions, it may be useful for the display to be randomly oriented in any of such positions. A consumer whose interest was not attracted upon first passing the display may nonetheless become interested upon subsequently passing the display after it has been rotated to show a different face.

BRIEF DESCRIPTION OF THE INVENTION

It is accordingly an object of the present invention to provide a rotating display, and a self-centering device for mounting such a display, which are capable, after rotation, of automatically aligning in one of a plurality of desired angular positions.

BRIEF DESCRIPTION OF THE DRAWINGS

For the purpose of illustrating the invention, there is shown in the drawings several embodiments which are presently preferred, it being understood, however, that this invention is not limited to the precise arrangements and instrumentalities shown.

FIG. 3(*b*) is a bottom plan schematic view showing a roller of the self-centering device being moved from one of the stable positions.

DETAILED DESCRIPTION OF THE PREFERRED EMBODIMENTS

Figure 1:
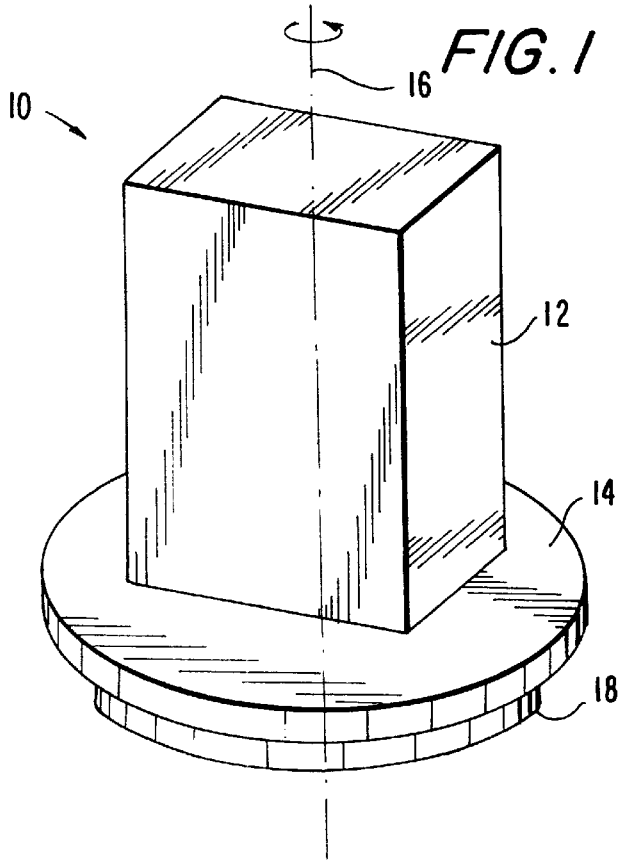
FIG. 1 is a perspective schematic view of a rotatable display illustrating certain features of the present invention.

Referring now to the drawings, and particularly to FIG. 1, there is shown a rotatable display 10 with which the self centering device of the present invention may be advantageously used.

The rotatable display 10 includes a display case 12 in which items to be displayed (e.g., makeup or jewelry) are located. The display case 12 sits on an upper plate 14, which may be a turntable, which can be rotated about a central axis 16 by a person, such as a consumer, observing the display case. This allows the consumer to see the objects located in the display case from various angles. The display case 12 can also be divided into front and rear compartments in which case the display case would be rotated so as to alternatively bring the articles displayed in the front and rear compartments into the consumer's view as a consumer rotates the display case.

The upper plate 14 is mounted on a base plate 18 for rotation about the base plate 18. Any appropriate structure can be used for this purpose; for example, a ball bearing arrangement (not shown).

Figure 2:
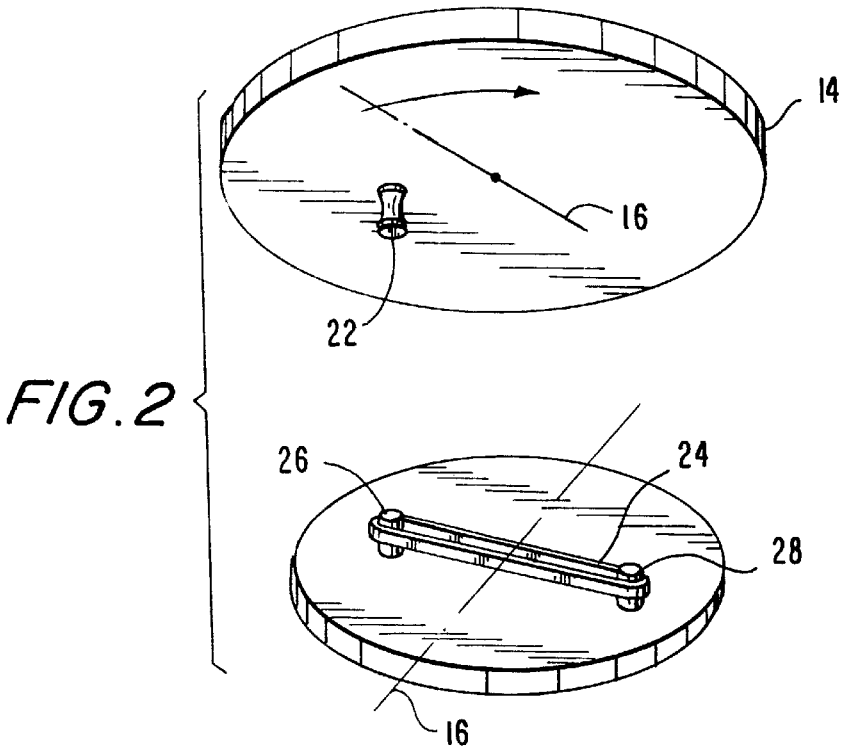
FIG. 2 is a perspective schematic exploded view of a first embodiment of a self-centering device used in the rotatable display of FIG. 1.
Figure 3B:
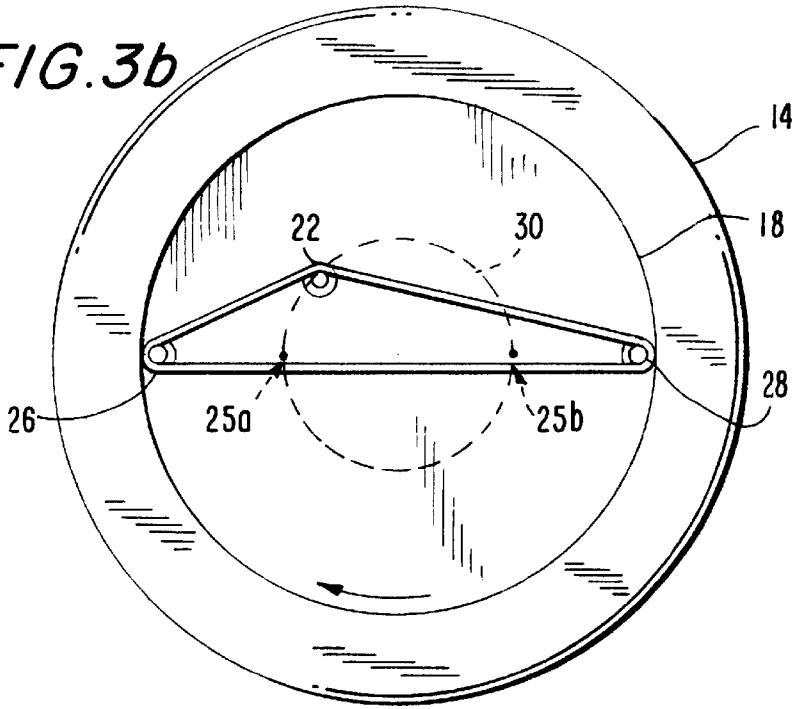
FIG. 3(*a*) is a bottom plan schematic view of the self-centering device of FIG. 2 showing the two stable positions of the self-centering device.
Figure 3A:
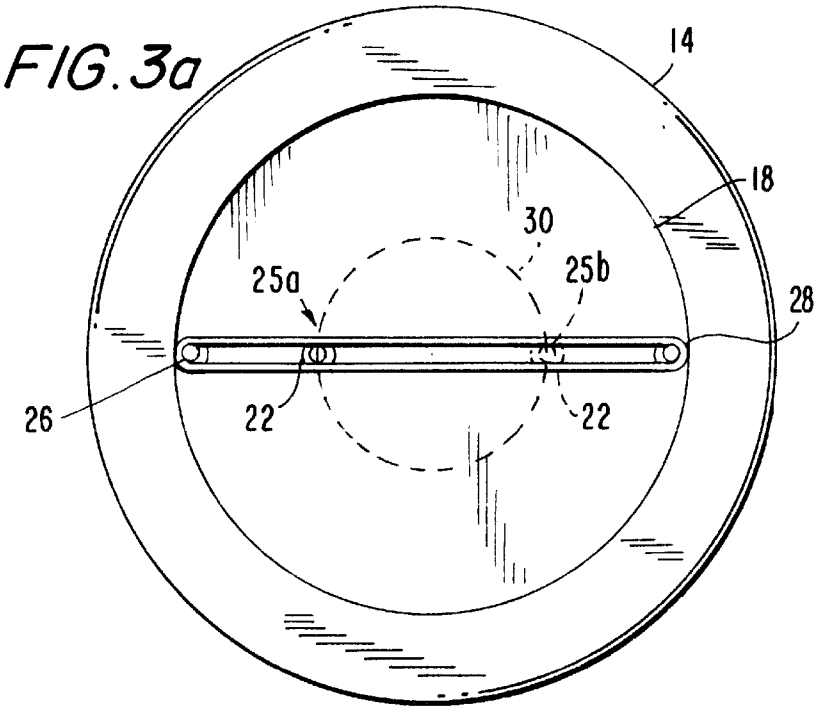
Figure 4:
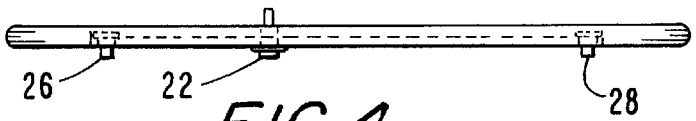
FIG. 4 is an elevation schematic view of the self-centering device with the roller in the position shown in FIG. 3(*a*).

A first embodiment of the self-centering mechanism of the invention is disclosed with reference to FIGS. 2–4.

FIG. 2 is an exploded view showing the upper side of the base plate 18 and the underside of the upper plate 14. The self-centering mechanism includes a force transferring element, such as a roller 22 which, as seen in FIG. 4, may take the form of a spinning sleeve or pulley rotatably mounted in the underside of the upper plate 14, and a flexible belt, such as an elastic O-ring 24, suspended around a pair of studs 26 and 28 fixedly mounted in the upper side of the base plate 18.

The manner in which the roller 22 cooperates with the O-ring 24 to self-center the upper plate 14, and with the display case 12, is best described with reference to FIGS. 3(*a*)–(*b*). As shown therein, the O-ring 24 engages the roller 22 as the upper plate 14 is rotated relative to the base plate 18. The circular path of the roller 22 as the top plate is rotated is shown by the dotted circle 30. As the roller 22 rotates, it stretches the O-ring 24, resulting in the elastic force of the O-ring 24 biasing the roller 22 into one of two stable positions 25*a*, 25*b*; in the first one 25*a*, the roller 22 is shown in solid lines in FIG. 3(*a*) and in the second one 25*b* the roller 22 is shown in dotted lines in FIG. 3(*a*). More specifically, referring to FIG. 3(*b*) as the upper plate 14 is rotated by an external force in the direction shown, such as by a consumer rotating the upper plate 14 or the display case 12 (FIG. 1), the roller 22 moves from one of its two stable positions (e.g., the first stable position 25*a*) toward its other stable position (e.g., the second stable position 25*b*). If the external force is removed when the roller 22 is less than 90° from the first stable position 25*a*, the force (moment) exerted by the portion of the O-ring located between the first stable position 25*a* and the roller 22 is greater than the force between the roller and the second stable position 25*b*. Accordingly, if the external force rotation of the upper plate 14 is removed at this point, that is, if it is removed at any point between the first stable position 25*a* and 90° therefrom, the upper plate 14 will return to the position in which the roller 22 is in the first stable position 25*a*. If, however, the roller 22 is less than 90° from the second stable position 25*b*, then the force exerted by the portion of the O-ring 24 between the roller 22 and the second stable position 25*b* is greater than the force exerted between the roller 22 and the first stable position 25*a*. Accordingly, if the external force rotating the upper plate 14 is removed at this point, the upper plate 14 will continue rotating towards the second stable position 25*b* where it will stay until an external force is again applied to the plate 14.

It should be noted that, theoretically, at the points 90° from each of the stable positions 25*a*, 25*b*, the forces exerted on the roller 22 should be equal. Accordingly, the upper plate 14 should stay at such points if the external force is removed when the roller 22 is at the 90° points; however, from a practical standpoint, any slight movement which would cause the upper plate 14 to move to either side of a 90° point, will cause the roller 22 to move to one or the other of the first and second stable positions 25*a*, 25*b*. Accordingly, these 90° points are not considered to be stable positions.

Figure 5:
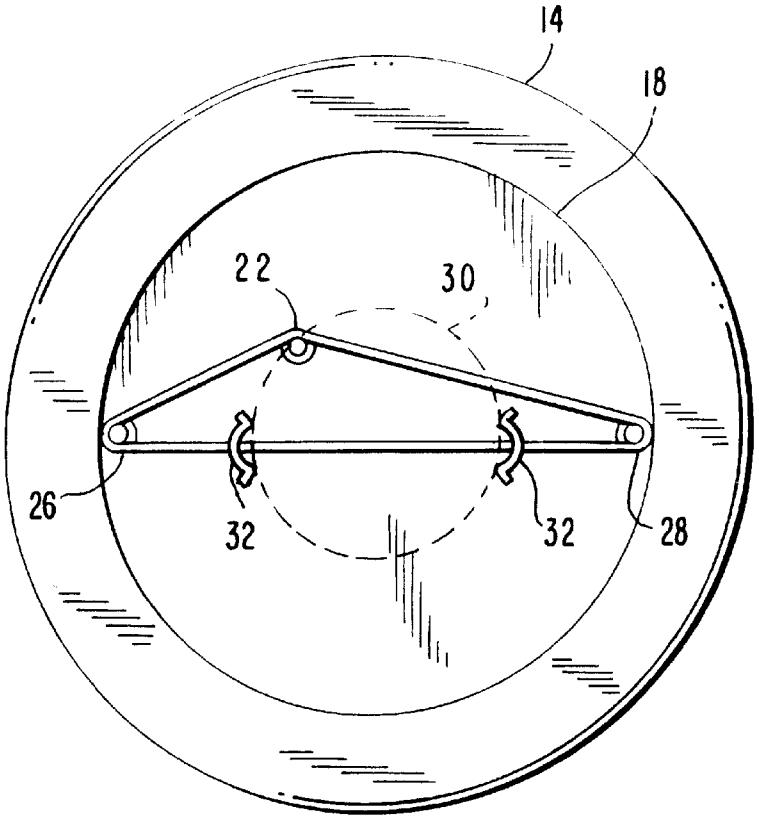
FIG. 5 is a bottom plan schematic view of an alternative embodiment of the self-centering device employing detents.

As shown in FIG. 5, a pair of detents 32 can be provided at the two stable positions 25*a*, 25*b* to further lock the upper plate 14 in the desired positions. The detents 32 are structured and arranged such as to prevent any movement of the roller 22 from the first and second stable positions 25*a*, 25*b* unless a predetermined threshold force is applied to the upper plate 14.

Figure 6:
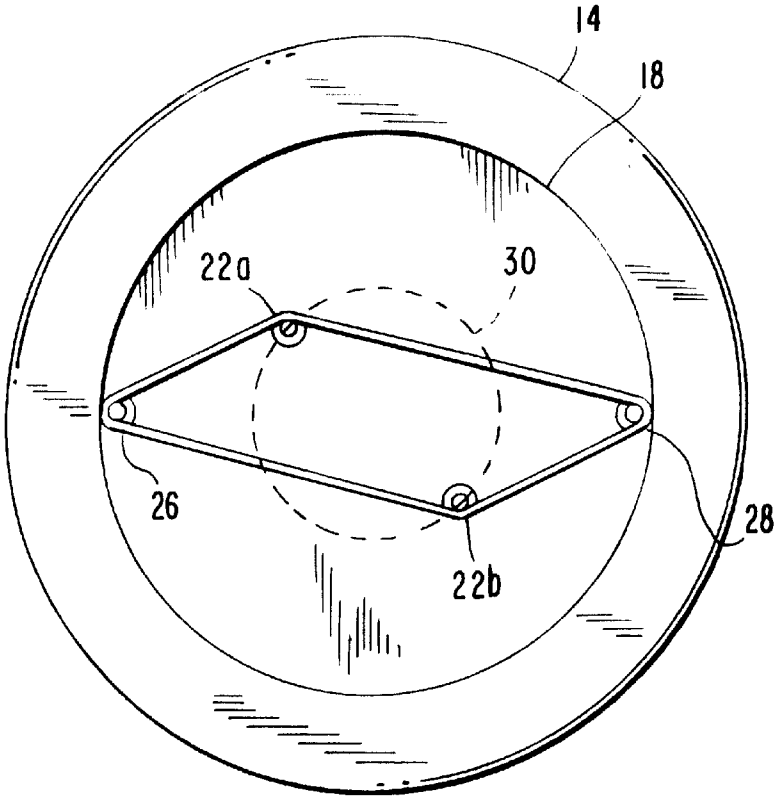
FIG. 6 is a bottom plan schematic view of another alternative embodiment of the self-centering device employing two rollers.

Referring now to FIG. 6, there showing an alternative embodiment employing two rollers 22*a* and 22*b*, with the two rollers being located diametrically opposite each other. Operation of this embodiment is similar to the first embodiment, except that opposite forces are applied to the two rollers 22*a*, 22*b*, thereby essentially doubling the centering force of the first embodiment. Similar to the first embodiment, detents 32 (not shown) may be provided in connection with the second embodiment to more assuredly lock the upper plate 14 in the first and second stable positions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A self-centering device, comprising a) a first plate;

b) a second plate rotatably mounted to the first plate and free to rotate about an axis of rotation to at least two spaced stable positions, c) a first post mounted on the first plate at the first stable position;

d) a second post mounted on the first plate at the second stable position;

e) a flexible belt entrained about the first and second posts and defining a circumscribed space; and f) a force transferring element projecting from the second plate into the circumscribed space and movable about the axis with the second plate when an external rotatable force is applied to the second plate such as to stretch the flexible belt, the flexible belt thereby applying forces to move the second plate to either the first or the second stable position when the external force is removed.

2. The self-centering device of claim 1, wherein the flexible belt is an O-ring.

3. The self-centering device of claim 1, wherein the force transferring device is a roller rotatable mounted in an underside of the second plate.

4. The self-centering device of claim 3, further comprising a second roller spaced from the first roller and projecting from the second plate into the circumscribed space.

5. The self-centering device of claim 4, wherein the rollers are diametrically positioned with respect to each other.

6. The self-centering device of claim 1, further including respective detents located at the first and second stable positions to prevent movement of the second plate from these positions unless a threshold level external rotatable force is applied to the second plate.

7. A rotatable display, comprising a) a base;

b) a turntable rotatably mounted on the base and free to rotate about an axis of rotation to at least two spaced stable positions;

c) a first post mounted on the base at the first stable position;

d) a second post mounted on the base at the second stable position;

e) a flexible belt entrained about the first and second posts and defining a circumscribed space;

f) a display case mounted in the turntable, and g) a roller depending from the turntable into the circumscribed space and movable about the axis with the turntable when an external rotatable force is applied to the turntable such as to stretch the flexible belt, the flexible belt thereby applying forces to move the turntable to either the first or the second stable position when the external force is removed.

8. The rotatable display of claim 7, further comprising a second roller spaced from the first roller and projecting from the second plate into the circumscribed space.

9. The rotatable display of claim 8, wherein the rollers are diametrically positioned with respect to each other.

10. The rotatable display of claim 7, further including respective detents located at the first and second stable positions to prevent movement of the second plate from these positions unless a threshold level external rotatable force is applied to the second plate.

11. A rotatable display, comprising a) a base;

b) a turntable rotatably mounted on the base and free to rotate about an axis of rotation to at least two spaced stable positions;

c) a first post mounted on the base at the first stable position;

d) a second post mounted on the base at the second stable position;

e) a flexible belt entrained about the first and second posts and defining a circumscribed space;

f) a display case mounted on the turntable;

f) first and second spaced and diametrically positioned rollers depending from the turntable into the circumscribed space and movable about the axis with the turntable when an external rotatable force is applied to the turntable such as to stretch the flexible belt, the flexible belt thereby applying forces to move the turntable to either the first or the second stable position when the external force is removed; and h) respective detents located at the first and second stable positions to prevent movement of the turntable from these positions unless a threshold level rotatable force is applied to the turntable.

* * * * *